US009281596B2

(12) United States Patent
Endo et al.

(10) Patent No.: US 9,281,596 B2
(45) Date of Patent: Mar. 8, 2016

(54) CONNECTOR TERMINAL AND METHOD OF FABRICATING THE SAME

(71) Applicant: DAI-ICHI SEIKO CO., LTD., Kyoto (JP)

(72) Inventors: Takayoshi Endo, Shizuoka (JP); Sakai Yagi, Shizuoka (JP); Jun Mukunoki, Shizuoka (JP); Yuji Kano, Fukuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/458,604

(22) Filed: Aug. 13, 2014

(65) Prior Publication Data

US 2015/0056872 A1 Feb. 26, 2015

(30) Foreign Application Priority Data

Aug. 26, 2013 (JP) ..... 2013-174572

(51) Int. Cl.

| | |
|---|---|
| ***H01R 13/40*** | (2006.01) |
| ***H01R 13/213*** | (2006.01) |
| ***H01R 4/18*** | (2006.01) |
| ***H01R 13/04*** | (2006.01) |
| ***H01R 43/16*** | (2006.01) |
| ***H01R 24/66*** | (2011.01) |
| *H01R 13/422* | (2006.01) |

(52) U.S. Cl.

CPC ..... *H01R 13/213* (2013.01); *H01R 4/185* (2013.01); *H01R 13/04* (2013.01); *H01R 24/66* (2013.01); *H01R 43/16* (2013.01); *H01R 13/4223* (2013.01); *Y10T 29/49204* (2015.01); *Y10T 428/12236* (2015.01)

(58) Field of Classification Search

CPC ..... H01R 13/4223; H01R 13/213; H01R 13/185; H01R 13/04; H01R 43/16; H01R 13/41; H01R 23/7073; H01R 12/585; H01R 43/02

USPC ..... 439/884

See application file for complete search history.

(56) References Cited

U.S. PATENT DOCUMENTS

| | | | | |
|---|---|---|---|---|
| 5,445,541 A | | 8/1995 | May et al. | |
| 5,591,054 A | * | 1/1997 | Okada et al. | 439/884 |
| 5,664,974 A | * | 9/1997 | Endo et al. | 439/884 |
| 5,860,836 A | * | 1/1999 | Ohno | H01R 13/4223 439/752.5 |
| 5,989,079 A | * | 11/1999 | Seko | H01R 13/057 439/745 |

(Continued)

FOREIGN PATENT DOCUMENTS

| | | |
|---|---|---|
| EP | 0 977 318 | 2/2000 |
| EP | 1 278 269 | 1/2003 |

(Continued)

*Primary Examiner* — Tulsidas C Patel
*Assistant Examiner* — Peter G Leigh
(74) *Attorney, Agent, or Firm* — Wenderoth, Lind & Ponack, L.L.P.

(57) ABSTRACT

A connector terminal comprised of a single bent metal sheet, includes a contact portion including a first sheet portion and a second sheet portion, the first sheet portion and the second sheet portion being folded to overlap one on another, a terminal body, and a connector portion connecting the terminal body and the contact portion to each other, the connector portion including a reinforcement portion covering therewith an end surface of the first sheet portion, an end surface of the second sheet portion, and at least a part of a surface of the second sheet portion in a part of the contact portion.

7 Claims, 12 Drawing Sheets

(56) References Cited

U.S. PATENT DOCUMENTS

| | | | | |
|---|---|---|---|---|
| 6,402,575 | B1 * | 6/2002 | Suzuki | H01R 13/04 439/866 |
| 6,638,117 | B2 * | 10/2003 | Murakami et al. | 439/849 |
| 6,659,814 | B2 * | 12/2003 | Kojima | 439/884 |
| 6,666,734 | B2 * | 12/2003 | Fukatsu | 439/884 |
| 6,679,738 | B2 * | 1/2004 | Nimura | H01R 43/16 439/752.5 |
| 6,752,669 | B2 * | 6/2004 | Murakami | H01R 13/04 439/884 |
| 6,755,696 | B1 * | 6/2004 | Ko | H01R 13/432 439/746 |
| 6,790,106 | B2 * | 9/2004 | Ito et al. | 439/884 |
| 6,866,551 | B2 * | 3/2005 | Murakami et al. | 439/884 |
| 7,044,809 | B2 * | 5/2006 | Kuroda | H01R 43/16 439/660 |
| 7,090,547 | B2 * | 8/2006 | Machida et al. | 439/866 |
| 8,740,645 | B2 * | 6/2014 | Hirabayashi | H01R 13/4223 439/595 |
| 8,979,602 | B2 * | 3/2015 | Cappe et al. | 439/884 |
| 2002/0002011 | A1 | 1/2002 | Shirouzu et al. | |
| 2002/0106943 | A1 * | 8/2002 | Katsuma | 439/733.1 |
| 2003/0017757 | A1 * | 1/2003 | Murakami | H01R 13/04 439/884 |
| 2003/0199211 | A1 * | 10/2003 | Fukatsu | H01R 13/055 439/884 |
| 2005/0118884 | A1 * | 6/2005 | Lutsch | H01R 13/428 439/746 |
| 2008/0146090 | A1 * | 6/2008 | Shimizu | H01R 43/16 439/842 |
| 2010/0041280 | A1 * | 2/2010 | Morello | H01R 13/422 439/752 |
| 2011/0212654 | A1 * | 9/2011 | Suzuki et al. | 439/733.1 |
| 2012/0034826 | A1 * | 2/2012 | Ishikawa et al. | 439/733.1 |
| 2015/0056872 | A1 * | 2/2015 | Endo et al. | 439/733.1 |

FOREIGN PATENT DOCUMENTS

| | | |
|---|---|---|
| JP | 57-49908 | 11/1992 |
| JP | 10-294145 | 11/1998 |
| JP | 3478010 | 10/2003 |
| JP | 2008-153074 | 7/2008 |
| KR | 10-0554456 | 3/2006 |
| NL | 6911542 | 7/1969 |

* cited by examiner

CONNECTOR TERMINAL AND METHOD OF FABRICATING THE SAME

The entire disclosure of Japanese Patent Application No. 2013-174572 filed on Aug. 26, 2013 including the specification, claims, drawings and summary is incorporated herein by reference in its entirety.

BACKGROUND OF THE INVENTION

1. Field of the Invention

The invention relates to a connector terminal, a single metal sheet of which the connector terminal is fabricated, and a method of fabricating the connector terminal through the use of the metal sheet.

2. Description of the Related Art

Japanese Patent No. 3478010 has suggested a male connector terminal including a contact portion formed by bending a metal sheet.

FIG. 12 is a partial perspective view of the male connector terminal 100 suggested in the above-identified Japanese Patent. The male connector terminal 100 can be fabricated by a sheet made of copper alloy, for instance. The male connector terminal 100 integrally includes a barrel portion (not illustrated), a projecting contact portion 110 to be inserted into a female connector terminal, and a body portion 120 connecting the barrel portion and the projecting contact portion 110 to each other. The body portion 120 includes a top wall portion 121, and a sheet portion 122 lying immediately below the top wall portion 121. A reinforcement portion 123 extending from a distal end of the sheet portion 122 enters a proximal portion of the projecting contact portion 110.

The male connector terminal 100 further includes a sidewall 124 between the top wall portion 121 and the projecting contact portion 110 to compress a side of the reinforcement portion 123. The sidewall 124 prevents the reinforcement portion 123 from slipping out of the projecting contact portion 110 and reinforces a proximal portion of the projecting contact portion 110.

However, even if the sidewall 124 compresses the reinforcement portion 123 at a side thereof, since there is formed an opening 125 at a side of a portion connecting the projecting contact portion 110 and the body portion 120 to each other, a stress is concentrated at a proximal portion of the projecting contact portion 110, if an excessive external force is exerted on the projecting contact portion 110. This results in that the portion connecting the projecting contact portion 110 and the body portion 120 to each other is collapsed to thereby narrow the opening 125.

SUMMARY OF THE INVENTION

In view of the above-mentioned problem in the conventional connector terminal, it is an object of the present invention to provide a connector terminal capable of enhancing a strength of a proximal portion in a contact portion to be inserted into a female connector terminal.

It is further an object of the present invention to provide a single metal sheet of which the above-mentioned connector terminal is fabricated.

It is further an object of the present invention to provide a method of fabricating the above-mentioned connector terminal through the use of the above-mentioned metal sheet.

In one aspect of the present invention, there is provided a connector terminal comprised of a single bent metal sheet, including a contact portion including a first sheet portion and a second sheet portion, the first and second sheet portions being folded to overlap one on another, a terminal body, and a connector portion connecting the terminal body and the contact portion to each other, the connector portion including a reinforcement portion covering therewith an end surface of the first sheet portion, an end surface of the second sheet portion, and at least a part of a surface of the second sheet portion in a proximal part of the contact portion.

In the connector terminal in accordance with the present invention, the reinforcement portion covers therewith an end surface of the first sheet portion, an end surface of the second sheet portion, and at least a part of a surface of the second sheet portion. That is, there is formed a three-layered structure at a proximal portion of the contact portion, and accordingly, at the connector portion. Thus, a strength of the connector portion against buckling can be further enhanced.

It is preferable that the reinforcement portion covers therewith an entire surface of the second sheet portion.

It is preferable that the reinforcement portion is formed with a recess at a surface thereof located above the second sheet portion.

A lance formed at a housing can be engaged with the recess. Hence, it is possible to prevent the connector terminal from slipping out of the housing by engaging the lance to the recess.

For instance, the reinforcement portion has a substantially L-shaped cross-section.

It is preferable that the connector portion has a substantially quadrangular-pyramid cross-section inclining towards the contact portion from the terminal body.

In another aspect of the present invention, there is provided a single metal sheet for fabricating a connector terminal, including at least a first area extending in parallel with a base line, a second area situated adjacent to the first area, a third area situated adjacent to the second area, and a fourth area situated adjacent to the third area, wherein a width at one of sides of the base line is equal to a width at the other side of the base line in the first area, a width at the one of sides of the base line is greater than the width of the first area, and a width at the other side of the base line is equal to the width of the first area in the second area, a width in the one of sides of the base line linearly increases from the width of the second area, and a width in the other side of the base line linearly increases from the width of the second area in the third area, and a width in the one of sides of the base line is equal to a final width of the third area, and a width in the other side of the base line linearly decreases from a final width of the third area in the fourth area.

In still another aspect of the present invention, there is provided a method of fabricating the above-mentioned connector terminal through the use of the above-mentioned single metal sheet, including folding the first area at the other side of the base line around the base line onto the first area at the one of sides of the base line, and bending the second to fourth areas at the other side of the base line into a quadrangular pyramid, and folding the second to fourth areas at the one of sides of the base line onto the second to fourth areas at the other side of the base line.

The advantages obtained by the aforementioned present invention will be described hereinbelow.

In the present invention, the reinforcement portion covers therewith an end surface of the first sheet portion, an end surface of the second sheet portion, and at least a part of a surface of the second sheet portion. That is, there is formed a three-layered structure at a proximal portion of the contact portion, and accordingly, at the connector portion. Thus, a strength of the connector portion against buckling can be further enhanced. Consequently, when the contact portion is inserted into a female connector terminal or when the connector terminal is inserted into a housing, the contact portion can be prevented from being bent or deformed at a proximal portion.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

The electric connector in accordance with a preferred embodiment of the present invention is explained hereinbelow with reference to drawings. In the specification, a male electric connector is inserted into the electric connector through a "front" of the electric connector, and the connector terminal is inserted into the electric connector through a "rear" of the electric connector.

Figure 1:
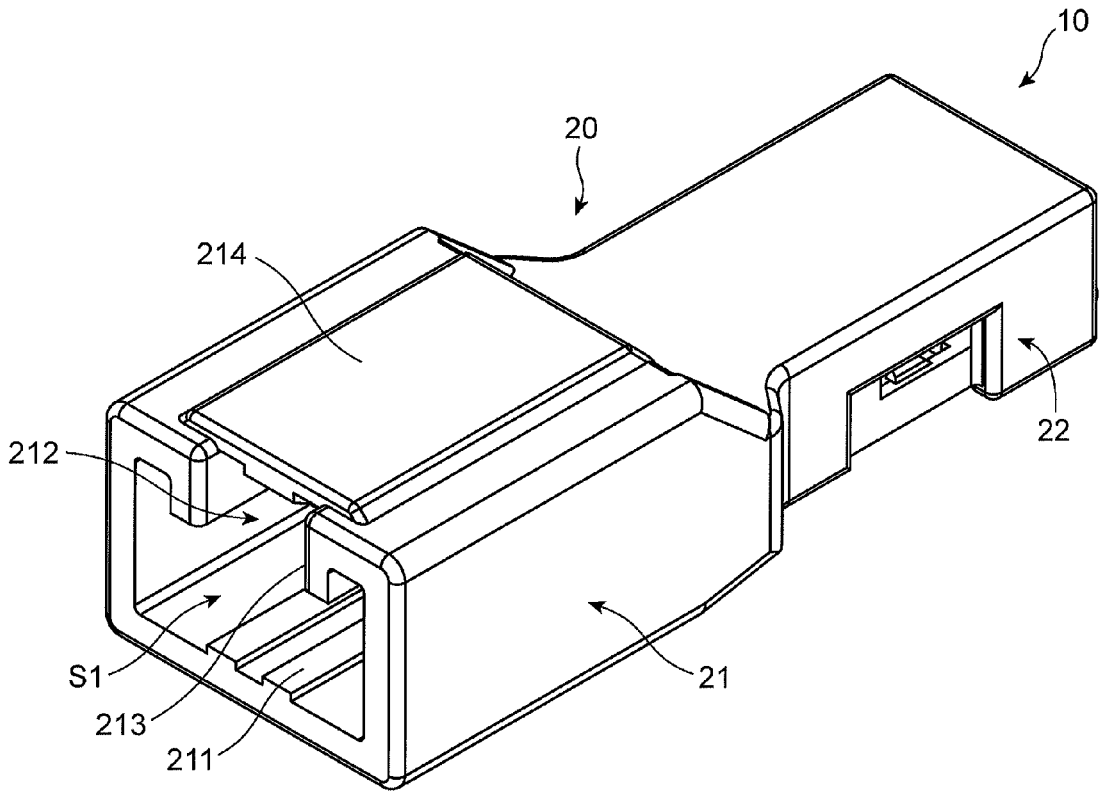
FIG. 1 is a perspective view of the electric connector in accordance with a preferred embodiment of the present invention.
Figure 2:
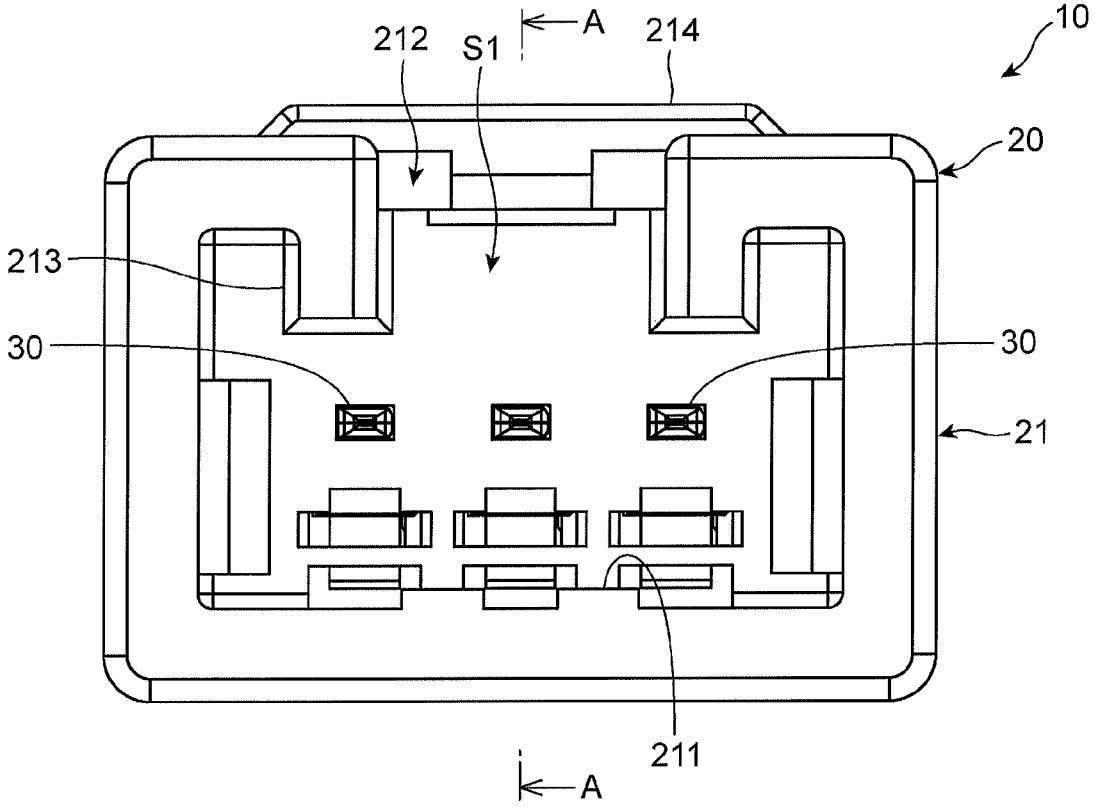
FIG. 2 is a front view of the electric connector in accordance with a preferred embodiment of the present invention.
Figure 3:
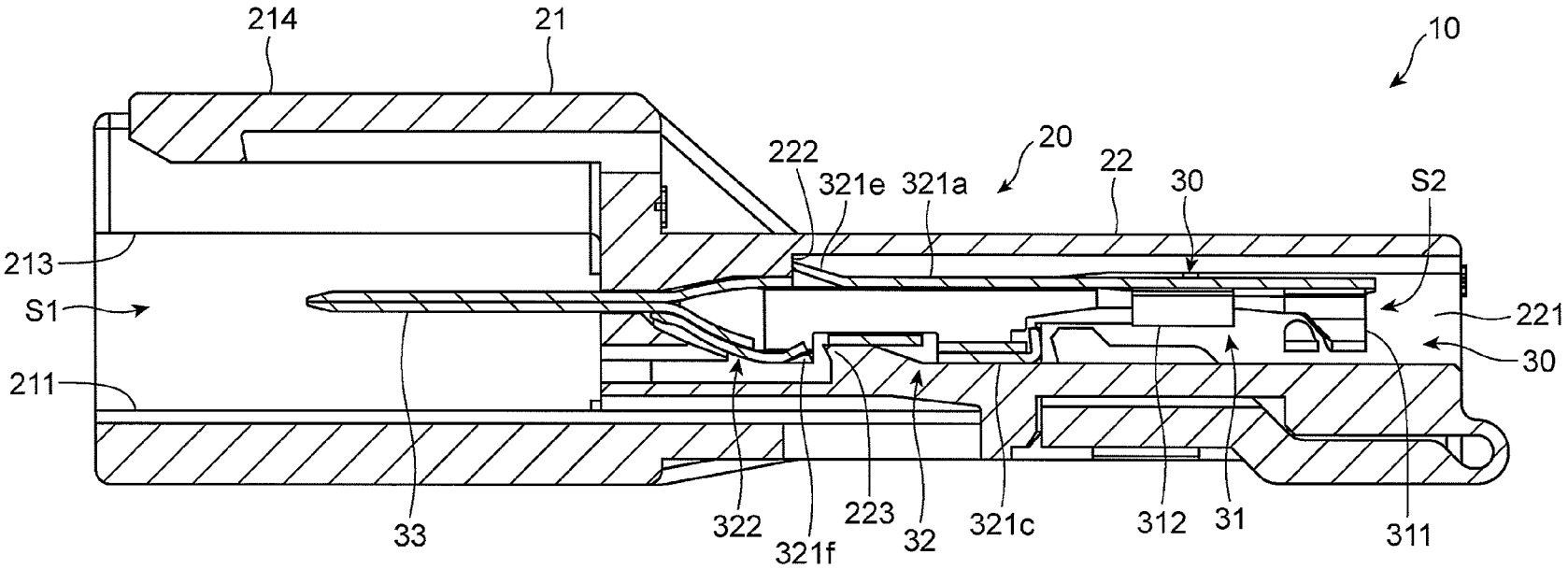
FIG. 3 is a cross-sectional view taken along the line A-A shown in FIG. 2.

The electric connector 10 illustrated in FIGS. 1 to 3, in accordance with the preferred embodiment, is used for an electric circuit equipped in an automobile, for instance. The electric connector 10 includes a housing 20 to be fit into a female electric connector (not illustrated), and a connector terminal 30 (see FIG. 3) including a later-mentioned contact portion 33 extending into a space of the housing 20.

The housing 20 can be fabricated by molding. The housing 20 includes a first portion 21 formed therein with a fitting space S1 into which a male housing is fit, and a second portion 22 formed therein with a terminal space S2 into which the connector terminal 30 is housed. The connector terminal 30 housed in the terminal space S2 extends a contact portion 33 thereof into the fitting space S1, as illustrated in FIG. 3.

The first portion 21 is in the form of a box, and has a rectangular opening. The first portion 211 is formed at inner surfaces thereof with projections 211 each having a rectangular cross-section, and a cut-out 212 having a rectangular cross-section in order to prevent a wrong male connector from being inserted into the fitting space S1 of the first portion 21, and further, to cause a male connector to be inserted into the fitting space S1 in a correct position when the male connector is attempted to be inserted into the fitting space S1 in an inclined position. Furthermore, edges of the cut-out 212 extend into the fitting space S1 to thereby define upright walls 213. A cover 214 covers therewith an opening formed by the cut-out 212.

The second portion 22 is in the form of a rectangular parallelepiped having a thickness smaller than the same of the first portion 21 and a length longer than the same of the first portion 21. The second portion 22 is formed therein with the three terminal spaces S2 horizontally arranged. Each of the terminal spaces S2 is formed at a rear with an opening 221 through which the connector terminal 30 is inserted into the terminal space S2, as illustrated in FIG. 3.

Each of the terminal spaces S2 is tapered at a front thereof in line with a shape of a later-mentioned connector portion of the connector terminal 30. Each of the terminal spaces S2 is formed at an inner ceiling with a stepped portion 222 (see FIG. 3) for restricting the movement of the connector terminal 30 when the connector terminal 30 is inserted into the terminal space S2. Each of the terminal spaces S2 is formed at an inner floor with a lance 223 (see FIG. 3) for preventing the connector terminal 30 from slipping out of the housing 20.

Figure 4:
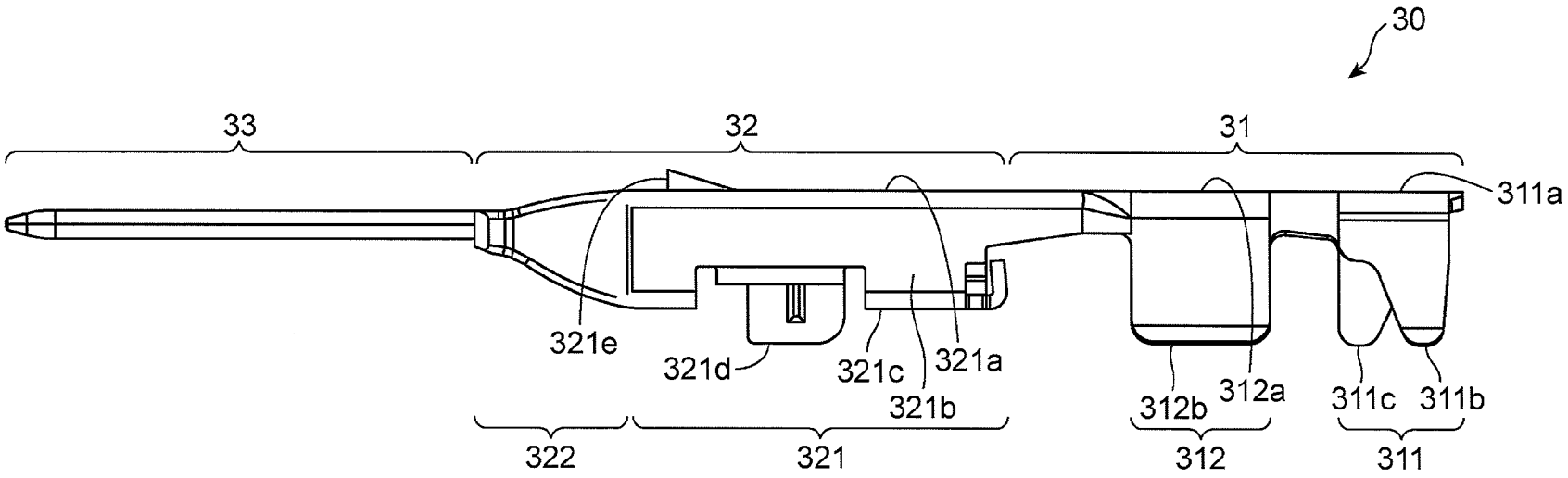
FIG. 4 is a side view of a connector terminal defining a part of the electric connector in accordance with a preferred embodiment of the present invention.

As illustrated in FIG. 4, the connector terminal 30 comprises a male terminal to be inserted into a female terminal. The connector terminal 30 includes a wire connection portion 31, a main body 32, and a contact portion 33.

A wire (not illustrated) in such a condition that a cover is stripped off at a distal end thereof to thereby cause a core to be exposed is fixed in the wire connection portion 31. The wire connection portion 31 includes a wire barrel portion 311 and a core barrel portion 312.

In the wire barrel portion 311, a wire (not illustrated) put on a wire receiver 311*a* (see FIG. 6) is compressed and fixed by bending a pair of upwardly extending walls 311*a* and 311*b* onto the wire.

In the core barrel portion 312, a core of a wire (not illustrated) put on a core receiver 312*a* (see FIG. 6) is compressed and fixed by bending a pair of upwardly extending walls 312*b* and 312*c* onto the core such that the core and the walls 312*b* and 312*c* and hence the connector terminal 30 are electrically connected to each other.

The main body 32 includes a terminal body 321 in the form of a square pipe, and a connector portion 322 connecting the terminal body 321 and the contact portion 333 to each other.

The terminal body 321 includes a pair of sidewalls 321*b* perpendicularly extending from a ceiling 321*a*, and a pair of floors 321*c* extending horizontally and inwardly from the sidewalls 321*b*. The floors 321*c* overlap one on another. A closed space is formed in the terminal body 321 by the ceiling 321*a*, the sidewalls 321*b* and the floors 321*c*. A stabilizer 321*b* vertically stands from one of the sidewalls 321*b* in a part of the terminal body 321 for the purpose of avoiding the connector terminal 30 from being inserted into the housing 20 upside down. The single floor 321*c* is formed where the stabilizer 321*d* stands.

Figure 5:
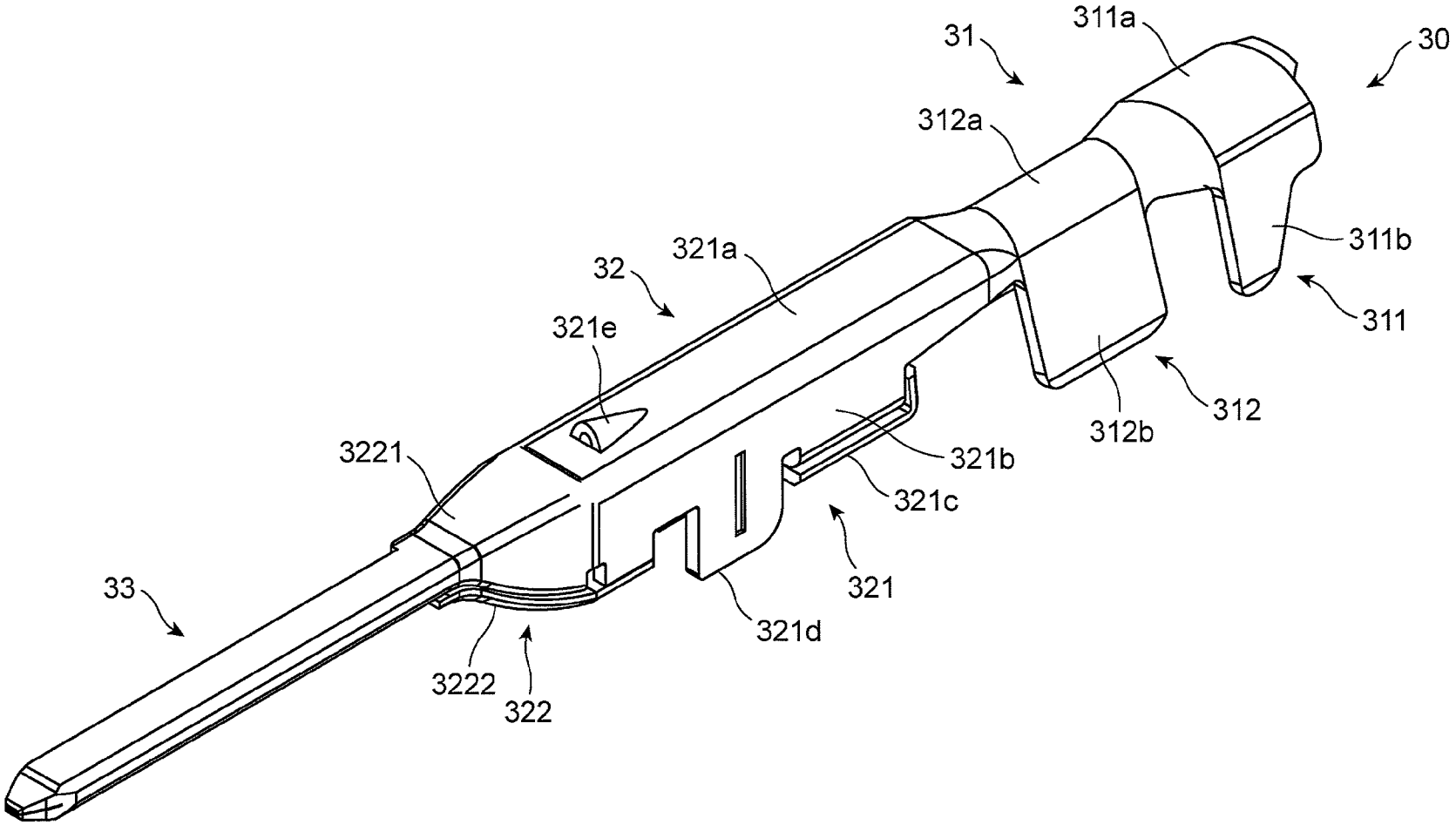
FIG. 5 is an upper perspective view of the connector terminal illustrated in FIG. 4.
Figure 6:
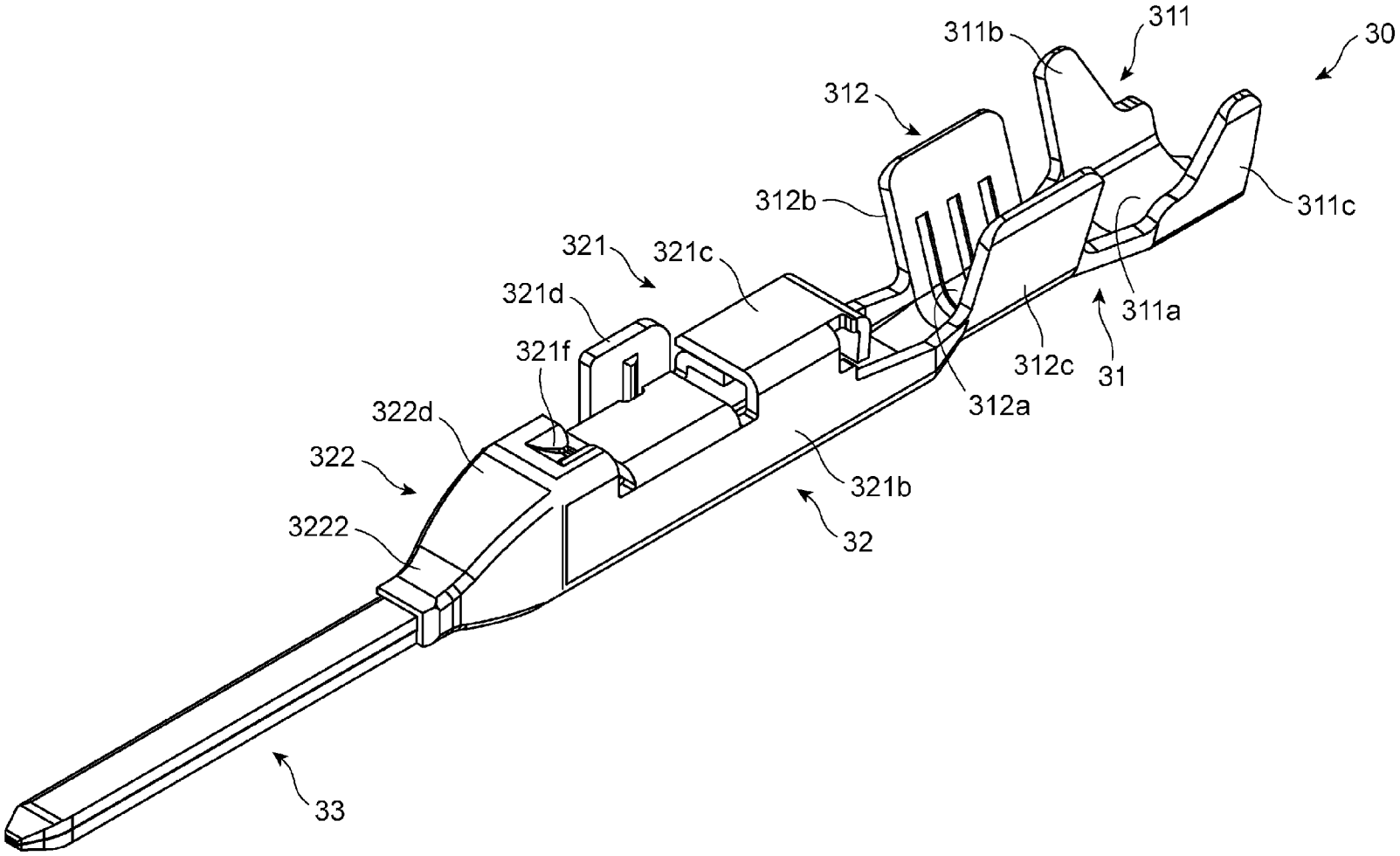
FIG. 6 is a lower perspective view of the connector terminal illustrated in FIG. 4.

As illustrated in FIG. 5, the terminal body 321 is formed at the ceiling 321*a* with a projection 321*e* with which the stepped portion 222 (see FIG. 3) formed in the terminal space S2 is engaged. The projection 321*e* is in the form of a semicircular cone. Furthermore, as illustrated in FIG. 6, the terminal body 321 is formed at the floors 321*c* with a recess 321*f* with which the lance 223 (see FIG. 3) formed in the terminal space S2 is engaged.

The connector portion 322 has a substantially quadrangular-pyramid cross-section inclining towards the contact portion 33 from the terminal body 321.

The connector portion 322 is designed tapered and extends from the terminal body 321 to the contact portion 33. The connector portion 322 includes a ceiling 322*a* (see FIG. 8) formed of a wall downwardly inclining from the ceiling 321*a* of the terminal body 321, a pair of sidewalls 322*b* and 322*c* (see FIG. 8) each having a gradually decreasing width, and thus, being in the form of a triangle, and a floor 322*d* (see FIG. 8) formed of a wall upwardly inclining from the floors 321*c* of the terminal body 321.

Figure 7:
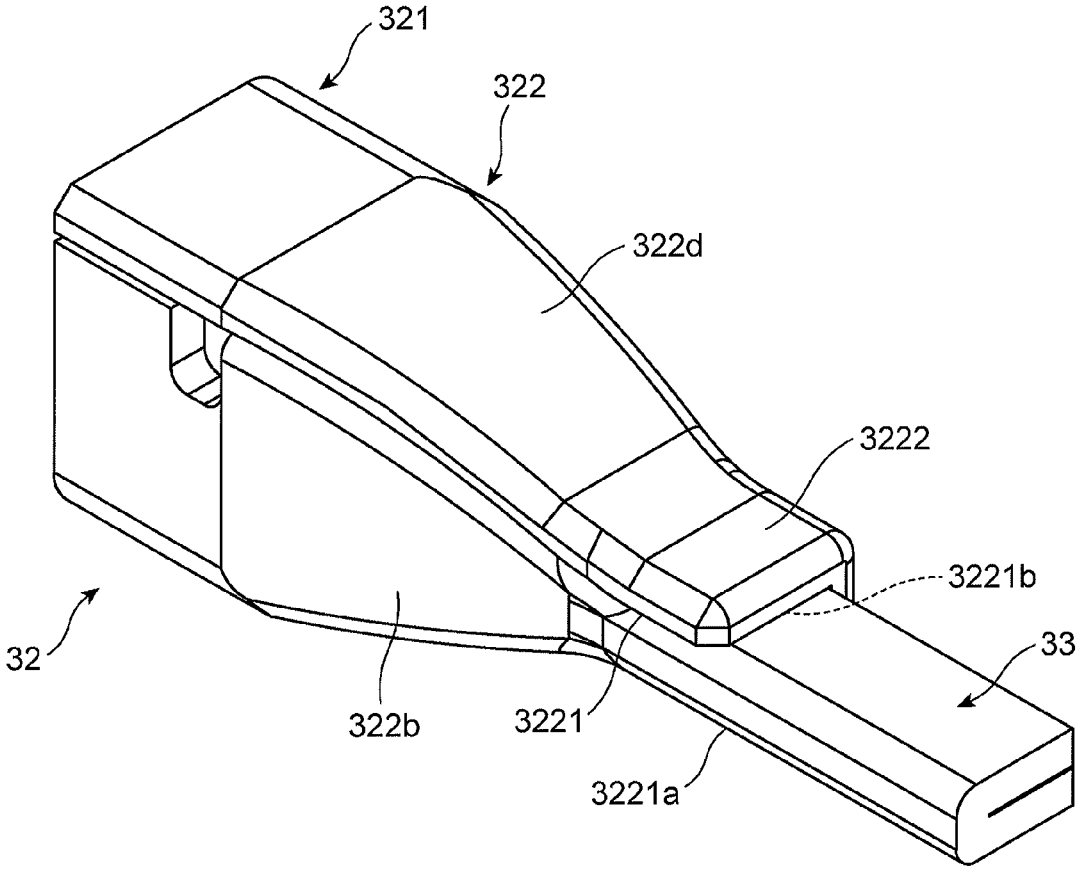
FIG. 7 is an enlarged perspective view of the connector portion of the connector terminal.
Figure 8:
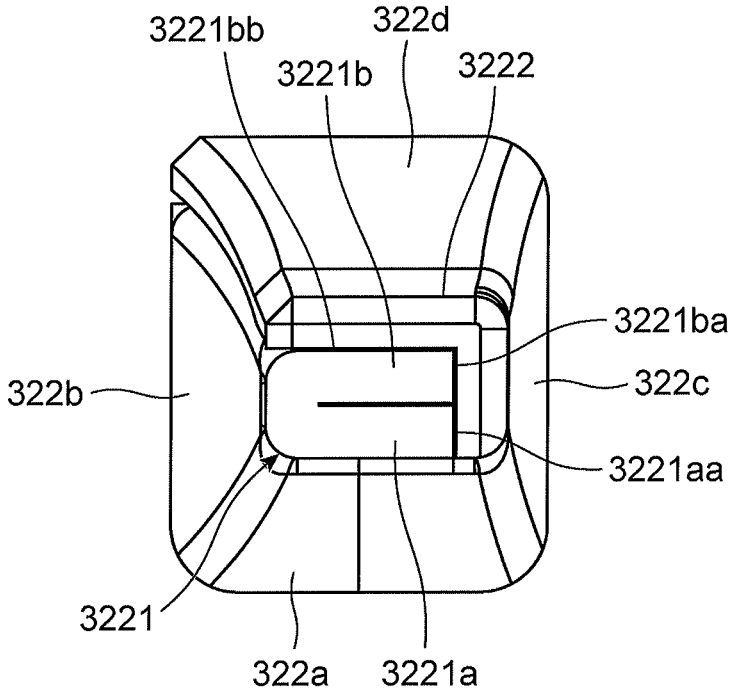
FIG. 8 is a front view of the connector portion of the connector terminal.

As illustrated in FIGS. 7 and 8, the connector portion 322 includes an extending portion 3221 formed as an extension of the contact portion 33, and a reinforcement portion 3222.

As illustrated in FIG. 8, the extending portion 3221 comprises a first sheet portion 3221*a* and a second sheet portion 3221*b*. The first and second sheet portions 3221*a* and 3221*b* are folded to overlap one on another. As mentioned later, the extending portion 3221 can be fabricated by folding a metal sheet into a U-shape.

As illustrated in FIG. 8, the reinforcement portion 3222 covers therewith an end surface 3221*aa* of the first sheet portion 3221*a*, an end surface 3221*ba* of the second sheet portion 3221*b*, and an entire surface 3221*bb* of the second sheet portion 3221*b*. The reinforcement portion 3222 has a substantially L-shaped cross-section, as illustrated in FIG. 8. Furthermore, the reinforcement portion 3222 is formed within a proximal part of the contact portion 33, as illustrated in FIG. 7.

The extending portion 3221 gradually increases a width thereof to thereby extend to and define a part of the ceiling 322*a*, one of the sidewalls 322*b*, and the floor 322*d*. The reinforcement portion 3222 lies on the surface 3221*bb* of the second sheet portion 3221*b* to thereby define a part of the other of the sidewalls 322*c* and the floor 322*d*.

The contact portion 33 defines a tab extending from the connector portion 322 to thereby be inserted into a female connector terminal.

Figure 9:
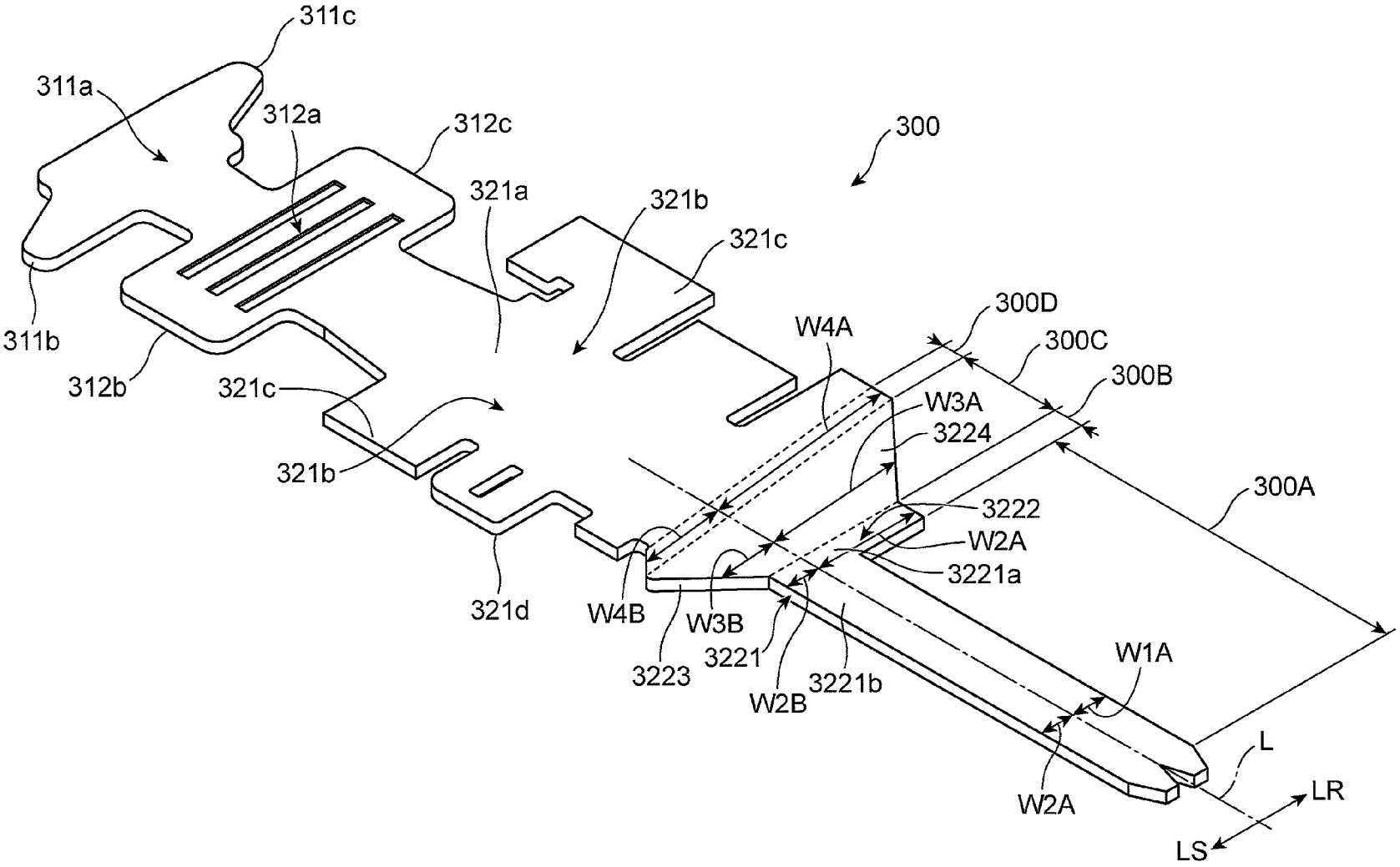
FIG. 9 is a perspective view of a metal sheet of which the connector terminal illustrated in FIGS. 4 to 6 is fabricated.

The connector terminal 30 can be fabricated from a single bent metal sheet. Specifically, the connector terminal 30 can be fabricated by punching an elastic metal sheet into a metal sheet 300 having such a predetermined shape as illustrated in FIG. 9, and bending the metal sheet 300 into the three-dimensional shape.

An order for fabricating the wire connection portion 31, the terminal body 32 and the contact portion 33 by bending the metal sheet 300 may be arbitrarily determined. For instance, the terminal body 32, the contact portion 33 and the wire connection portion 31 may be fabricated in this order. As an alternative, the wire connection portion 31, the terminal body 32 and the contact portion 33 may be fabricated in this order. The contact portion 33 may be first fabricated, and then, the terminal body 32 and the wire connection portion 31 may be concurrently fabricated. As an alternative, the wire connection portion 31, the terminal body 32 and the contact portion 33 may be concurrently fabricated.

The wire connection portion 31 is fabricated by putting a round-bar die on the wire receiver 311*a* and the core receiver 312*a*, and bending both the walls 311*b* and 311*c* of the wire barrel portion 311 and the walls 312*b* and 312*c* of the core barrel portion 312 around the round-bar die. Thus, the walls 311*b* and 311*c* obliquely stand with the wire receiver 311*a* being a summit to thereby define the substantially V-shaped wire barrel portion 311. Similarly, the walls 312*b* and 312*c* obliquely stand with the core receiver 312*a* being a summit to thereby define the substantially V-shaped core barrel portion 312.

The terminal body 321 is fabricated by putting a square-bar die on the ceiling 321*a* of the terminal body 321, and bending the metal sheet 300 around the square-bar die. Specifically, the sidewalls 321*b* are bent onto the square-bar die. Then, the sidewalls 321*b* are further bent at distal portions thereof around the square-bar die to thereby define the floors 321*c*. The stabilizer 321*d* is fabricated by causing one of the sidewalls 321*b* to stand without being further bent.

The metal sheet 300 is designed to have first to fourth areas to fabricate the connector portion 322 and the contact portion 33.

Specifically, as illustrated in FIG. 9, the metal sheet includes a first area 300A extending in parallel with a base line L, a second area 300B situated adjacent to the first area 300A, a third area 300C situated adjacent to the second area 300B, and a fourth area 300D situated adjacent to the third area 300C.

In the first area 300A, a width W1A at a side LR of the base line L is equal to a width W2A at the other side LS of the base line L.

In the second area 300B, a width W2A at the side LR of the base line L is greater than the width W1A of the first area 300A, and a width W2B at the other side LS of the base line L is equal to the width W1A of the first area 300A.

In the third area 300C, a width W3A in the side LR of the base line L linearly increases from the width W2A of the second area 300B, and a width W3B in the other side LS of the base line L linearly increases from the width W2B of the second area 300B.

In the fourth area 300D, a width W4A in the side LR of the base line L is equal to a final and maximum width of the third area 300C, and a width W4B in the other side LS of the base line L linearly decreases from a final and maximum width of the third area 300C.

The connector portion 322 and the contact portion 33 are fabricated by putting a tapered square-pole die on the metal sheet 300 such that a top of the die aligns with a top of the connector portion 322, and bending the metal sheet 300 around the die.

Figure 10:
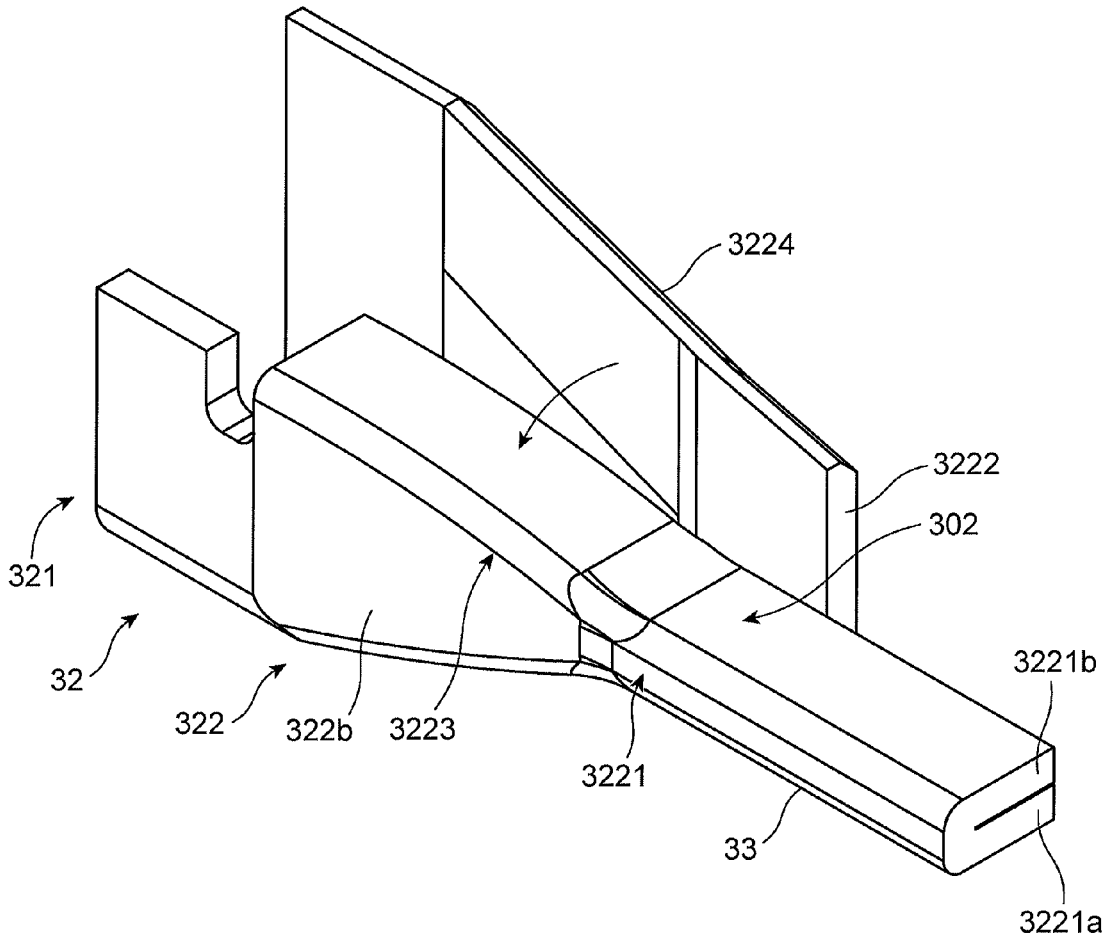
FIG. 10 illustrates one of steps of fabricating the connector portion of the connector terminal.
Figure 11:
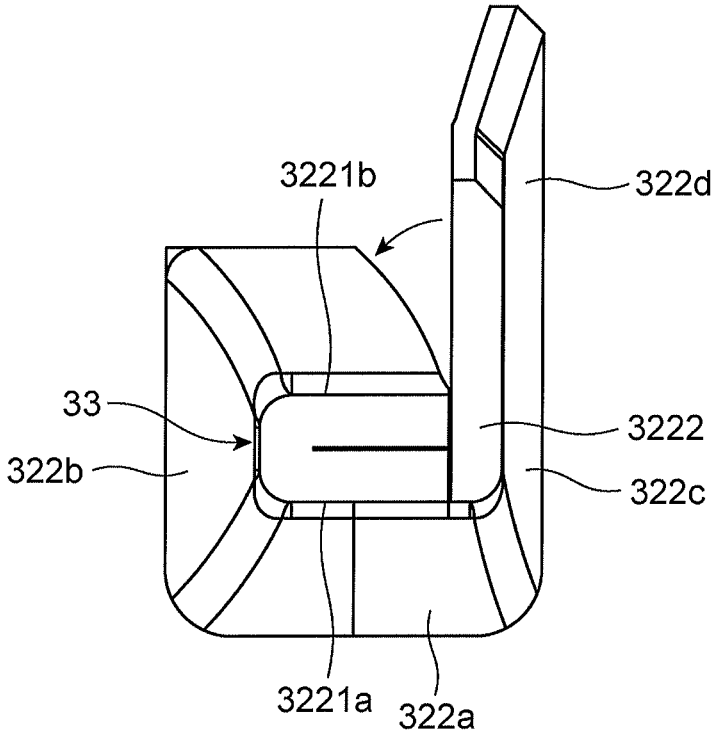
FIG. 11 is a front view of the connector portion illustrated in FIG. 10.

The first area 300A is in the form of an elongate rectangle, and is formed at a distal end thereof with a Y-shaped cut-out. The first area 300A is folded one on another around the base line L. As illustrated in FIGS. 10 and 11, the folded first area 300A defines the contact portion 33, and further defines the extending portion 3221 comprising the first sheet portion 3221*a* and the second sheet portion 3221*b* overlapping one on another. The extending portion 3221 is just an extension of the contact portion 33.

Then, the reinforcement portion 3222 upwardly extending and making touch with the end surfaces 3221*aa* and 3221*ba* (see FIGS. 10 and 11) is folded and compressed onto the second sheet portion 3221*b* (see FIG. 8). Thus, as illustrated in FIG. 8, the extending portion 3221 and the reinforcement portion 3222 make close contact with each other at a distal end of the connector portion 322. That is, there is formed a three-layered structure including three metal sheets in a thickness-wise direction (see FIGS. 7 and 8).

As illustrated in FIGS. 10 and 11, a triangular portion 3223 (the third area 300C and the fourth area 300D at the other side LS) is bent around the extending portion 3221 to thereby define the sidewall 322*b* and the floor 322*d*. Furthermore, a trapezoidal portion 3224 (the third area 300C and the fourth area 300D at the side LR) is bent around the extending portion 3221 to thereby define the sidewall 322*c* and the floor 322*d*.

Figure 12:
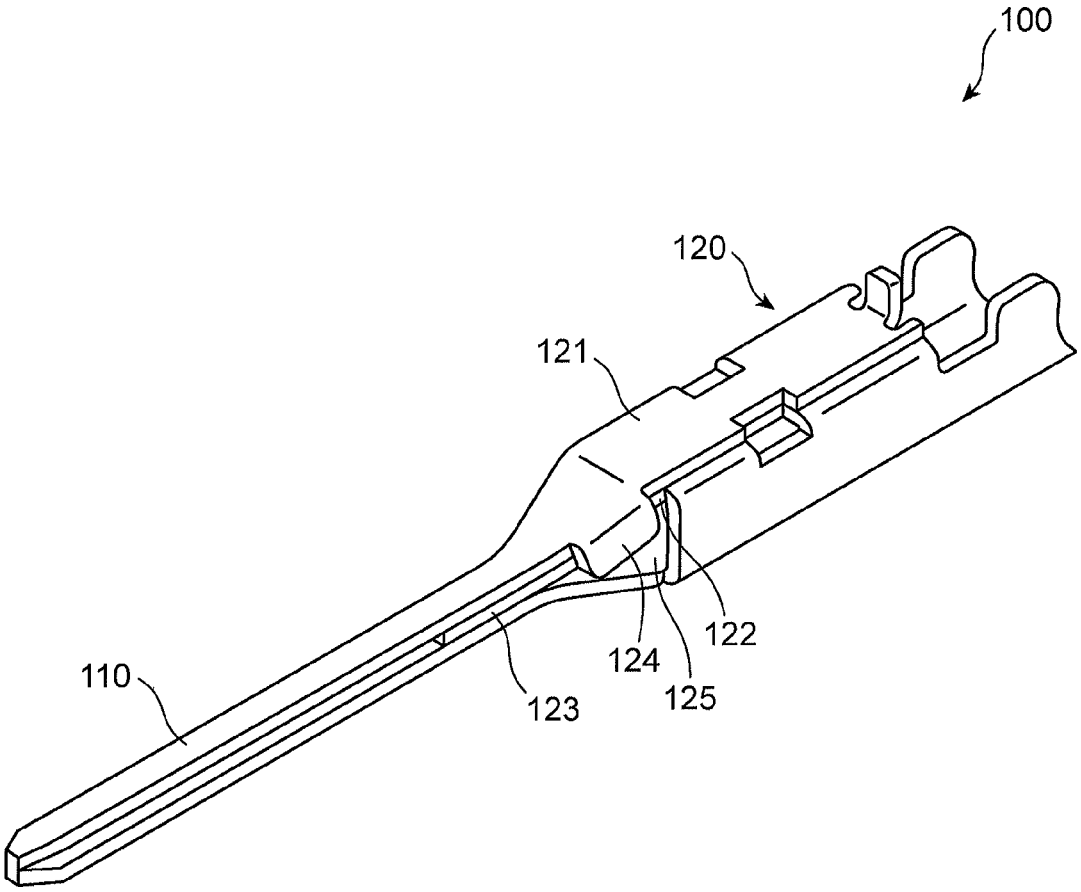
FIG. 12 is a perspective view of the conventional connector terminal.

As mentioned above, the reinforcement portion 3222 and the extending portion 3221 overlap one on another at a distal end of the connector portion 322 to thereby define a three-layered structure surrounded by the ceiling 322*a*, the sidewalls 322*b* and 322*c*, and the floor 322*d*. Thus, unlike the conventional terminal 100 illustrated in FIG. 12, there is not formed an opening such as the opening 125 at a side of a portion through which the projecting contact portion 110 and the body portion 120 are connected to each other. The opening 125 causes the body portion 120 to be collapsed to thereby narrow the opening 125.

In contrast, in the connector terminal 30, since the reinforcement portion 3222 is bent around the extending portion 3221 so as not to form an opening such as the opening 125, the reinforcement portion 3222 reinforces the connector portion 322. Thus, even if a stress is concentrated on a proximal portion of the contact portion 33 (that is, a distal portion of the connector portion 322) when the contact portion 33 is inserted into the housing 20 with a pressure or when the contact portion 33 is inserted into a female connector terminal, the connector terminal 30 can have an enhanced strength against buckling.

Furthermore, since the reinforcement portion 3222 lies on the second sheet portion 3221*b*, the first and second sheet portions 3221*a* and 3221*b* make close contact with each other, ensuring enhancement in the strength of connector portion 322. Since the reinforcement portion 3222 lies on the second sheet portion 3221*b*, even if a gap between the first and second sheet portions 3221*a* and 3221*b* gradually grows bigger, a bending portion of the extending portion 3221 defines the sidewall 322*b* of the connector portion 322, and the reinforcement portion 3222 defines the sidewall 322*c*, ensuring a strength against a stress acting on the contact portion 33 in a thickness-wise direction.

As illustrated in FIG. 6, the terminal body 321 is formed with the recess 321*f* which is to be engaged with the lance 223 projecting into the terminal space S2 (see FIG. 3). Thus, the lance 223 is engaged with the recess 321*f* when the connector terminal 30 is inserted into the terminal space S2, and hence, the connector terminal 30 can be prevented from being slipped out of the housing 20. The recess 321*f* can be formed at a desired position by forming a recess at the metal sheet 300 (see FIG. 9), and winding the reinforcement portion 3222 around the extending portion 3221.

In the preferred embodiment, the reinforcement portion 3222 is designed to cover therewith the entire surface 3221*bb* of the second sheet portion 3221*b*. As an alternative, the reinforcement portion 3222 may be designed to cover therewith a part of the surface 3221*bb* of the second sheet portion 3221*b*.

INDUSTRIAL APPLICABILITY

The connector terminal in accordance with the present invention can be broadly employed in an electric connector used in an electric/electronic device industry and an automobile industry, as a part to be inserted into and electrically connected with a female connector terminal.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A connector terminal comprised of a single bent metal sheet, including:

a contact portion including a first sheet portion and a second sheet portion, said first sheet portion and said second sheet portion being folded to overlap one on another; and a terminal body supporting said contact portion;

said terminal body including a hollow body having a rectangular cross section, and a connector portion connecting said hollow body and said contact portion to each other, said hollow body including a ceiling, a pair of sidewalls extending from opposite ends of said ceiling, and a floor connecting distal ends of said pair of sidewalls, said connector portion forwardly protruding from a front end of said hollow body, and integrally connecting said hollow body to said contact portion, said connector portion including:

a ceiling defined by a tapered surface extending from said ceiling of said hollow body;

a pair of sidewalls extending from opposite ends of said ceiling of said connector portion;

a floor defined by a tapered surface extending from said floor of said hollow body; and a reinforcement portion covering therewith an end surface of said first sheet portion, an end surface of said second sheet portion, and at least a part of a surface of said second sheet portion in a proximal part of said contact portion, said proximal part having a length in a widthwise direction of said contact portion, a first one of said pair of sidewalls of said connector portion and said floor of said connector portion being defined with said second sheet portion, in a state in which said second sheet portion is bent, a second one of said pair of sidewalls of said connector portion and said floor of said connector portion being defined with said reinforcement portion, in a state in which said reinforcement portion is bent, and said connector portion being defined at a distal area thereof with said reinforcement portion outwardly wound around said first sheet portion and said second sheet portion to thereby have a three-layered structure defined by said ceiling of said connector portion, said pair of sidewalls of said connector portion and said floor of said connector portion.

2. The connector terminal as set forth in claim 1, wherein said reinforcement portion covers therewith an entire surface of said second sheet portion.

3. The connector terminal as set forth in claim 1, wherein said reinforcement portion is formed with a recess at a surface thereof located above said second sheet portion.

4. The connector terminal as set forth in claim 1, wherein said reinforcement portion has a substantially L-shaped cross section.

5. The connector terminal as set forth in claim 1, wherein said connector portion has a substantially quadrangular-pyramid cross section inclining towards said contact portion from said terminal body.

6. A single metal sheet for fabricating a connector terminal, including at least:

a first area extending in parallel with a base line;

a second area situated adjacent to said first area;

a third area situated adjacent to said second area; and a fourth area situated adjacent to said third area, wherein:

a width at one of sides of said base line is equal to a width at the other side of said base line in said first area, a width at said one of sides of said base line is greater than said width of said first area, and a width at said other side of said base line is equal to said width of said first area in said second area, a width in said one of sides of said base line linearly increases from said width of said second area, and a width in said other side of said base line linearly increases from said width of said second area in said third area, and a width in said one of sides of said base line is equal to a final width of said third area, and a width in said other side of said base line linearly decreases from a final width of said third area in said fourth area.

7. A method of fabricating a connector terminal through use of a single metal sheet including a first area extending in parallel with a base line; a second area situated adjacent to said first area; a third area situated adjacent to said second area; and a fourth area situated adjacent to said third area, wherein a width at one of sides of said base line is equal to a width at the other side of said base line in said first area, a width at said one of sides of said base line is greater than said width of said first area, and a width at said other side of said base line is equal to said width of said first area in said second area, a width in said one of sides of said base line linearly increases from said width of said second area, and a width in said other side of said base line linearly increases from said width of said second area in said third area, and a width in said one of sides of said base line is equal to a final width of said third area, and a width in said other side of said base line linearly decreases from a final width of said third area in said fourth area, said connector terminal comprising a single bent metal sheet, including:

a contact portion including a first sheet portion and a second sheet portion, said first sheet portion and said second sheet portion being folded to overlap one on another;

a terminal body; and a connector portion connecting said terminal body and said contact portion to each other, said connector portion including a reinforcement portion covering therewith an end surface of said first sheet portion, an end surface of said second sheet portion, and at least a part of a surface of said second sheet portion in a proximal part of said contact portion, said method comprising:

folding said first area at said other side of said base line around said base line onto said first area at said one of sides of said base line, and bending said second to fourth areas at said other side of said base line into a quadrangular pyramid; and folding said second to fourth areas at said one of sides of said base line onto said second to fourth areas at said other side of said base line.

* * * * *